US005630448A

United States Patent [19]

Faasse

[11] Patent Number: 5,630,448

[45] Date of Patent: May 20, 1997

[54] HEDDLE FRAME WITH TORQUE LOCKING BLOCK CENTER BRACE ASSEMBLY

[75] Inventor: Gene E. Faasse, Taylors, S.C.

[73] Assignee: Steele Heddle Manufacturing Company, Greenville, S.C.

[21] Appl. No.: 621,252

[22] Filed: Mar. 25, 1996

[51] Int. Cl.[6] ..... D03C 9/06

[52] U.S. Cl. ..... 139/91

[58] Field of Search ..... 139/91

[56] References Cited

U.S. PATENT DOCUMENTS

| | | | |
|---|---|---|---|
| 3,417,790 | 12/1968 | Pfarrwaller | 139/91 |
| 3,889,721 | 6/1975 | Wagner . | |
| 4,091,844 | 5/1978 | Underwood | 139/91 |
| 4,513,933 | 4/1985 | Lueders . | |
| 4,635,685 | 1/1987 | Chabot . | |
| 4,658,864 | 4/1987 | Goodman, Jr. . | |
| 4,757,809 | 7/1988 | Koeneman et al. . | |
| 4,924,916 | 5/1990 | Faasse et al. . | |
| 5,082,031 | 1/1992 | Suhr . | |
| 5,332,006 | 7/1994 | Gaisser | 139/91 |
| 5,411,061 | 5/1995 | Faase . | |

*Primary Examiner*—Andy Falik

*Attorney, Agent, or Firm*—Dority & Manning, P.A.

[57] ABSTRACT

A heddle frame for supporting a plurality of heddles includes a top rail and a bottom rail extending longitudinally relative to the frame. End members connect the top rail and bottom rail so as to form a generally rectangular frame structure. A heddle bar is supported on the frame structure wherein heddles are supported by said heddle bars in the frame structure. A center brace extends between the top rail and the bottom rail at a position between the end members for maintaining parallelism of the top and bottom rails. The center brace includes an elongated center portion and first and second flanges at opposite longitudinal ends of the center portion. First and second locking blocks are respectively attached to the top rail and the bottom rail and are configured to respectively receive the first flange and the second flange and to exert forces on the first and second flanges to create opposing torques thereon. This places the center portion in torsion and locks the first flange and the second flange within their respective locking blocks.

13 Claims, 2 Drawing Sheets

Fig. 1
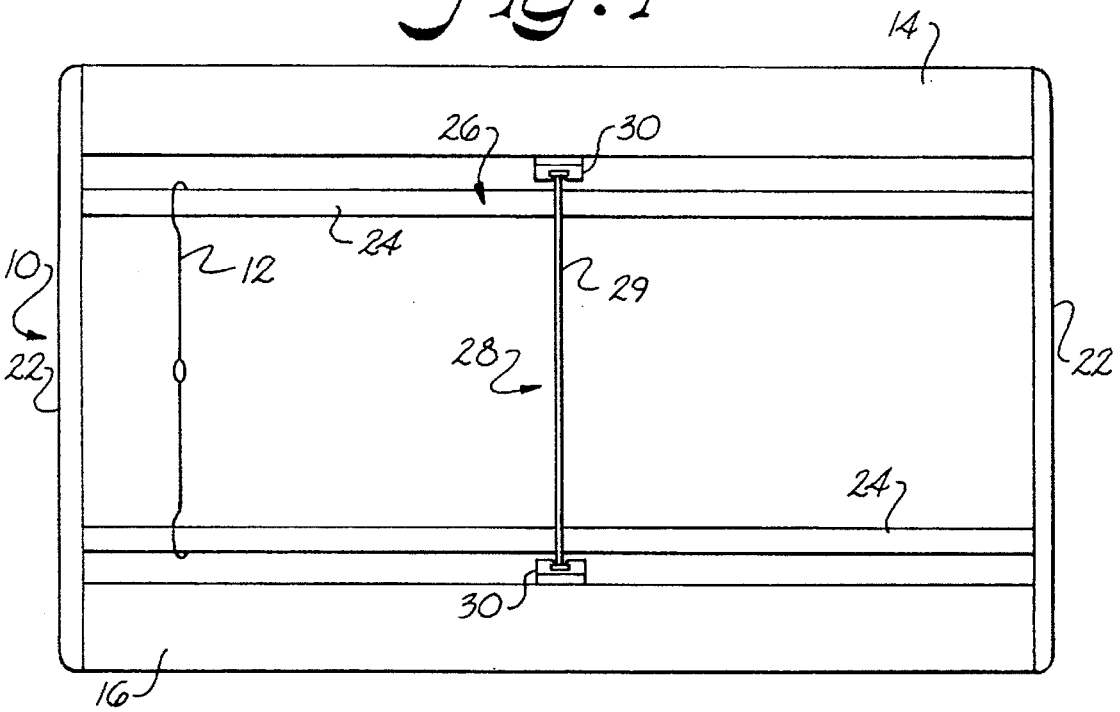
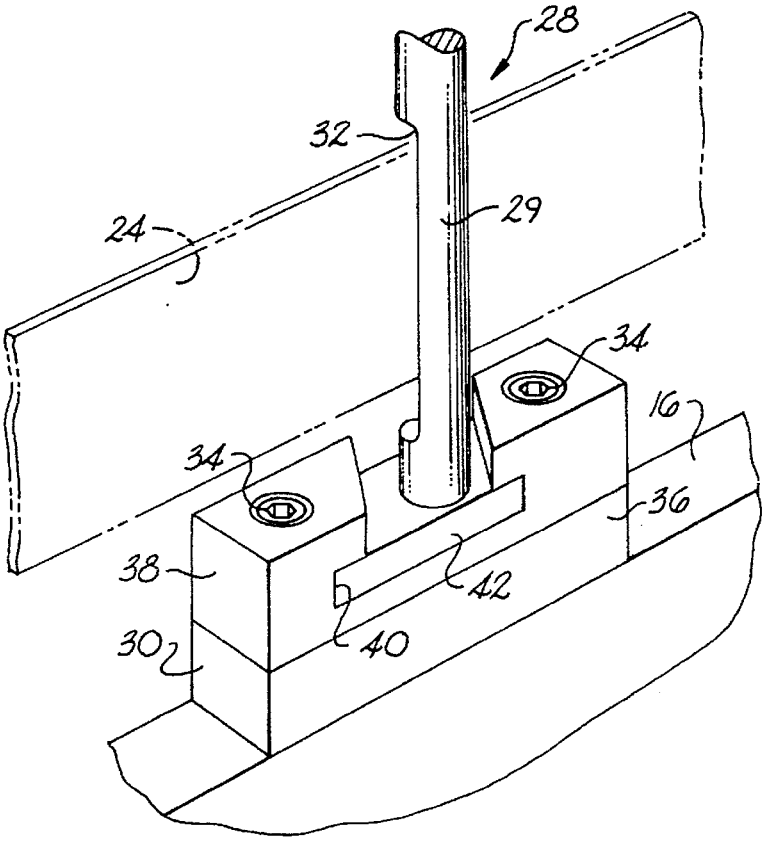
Fig. 2

HEDDLE FRAME WITH TORQUE LOCKING BLOCK CENTER BRACE ASSEMBLY

BACKGROUND OF THE INVENTION

The present invention relates to a heddle frame for a loom, and in particular to improved means in the heddle frame for preventing distortion with respect to the top and bottom rails of the heddle frame.

A known heddle frame with an improved center brace assembly is disclosed in U.S. Pat. No. 4,924,916. In this patent, the heddle frame comprises top and bottom rails which are typically made of extruded aluminum. The top and bottom rails are connected to each other at their ends by end struts or members to provide a rigid connection between the rails and to define a generally rectangular harness or heddle frame. The frame includes top and bottom heddle supporting rods upon which heddles are slideably mounted, as is commonly understood in the art. A center brace is mounted midway between the ends of the frame, and in some cases a plurality of braces may be employed. These center braces serve to prevent distortion of the frame and to maintain the parallel relationship between the top and bottom rails.

In the '916 patent, the center brace extends through an opening into the top rail and into an opening into the bottom rail. A top sleeve is disposed in the opening in the top rail and extends about the center brace to separate the brace from the opening in the top rail. Likewise, a bottom sleeve is disposed in the bottom rail and is threaded onto the center brace. Means are provided on the upper surface of the top rail to secure and retain the center brace within the opening, thereby supporting and maintaining the parallelism of the top and bottom rails. The lower end of the center brace is supported by a nut block which is attached to the upper surface or bottom surface of the bottom rail. The center brace is threadedly engaged within the nut block.

Although the device disclosed in the '916 patent provides a significant improvement in the art, a problem has existed in that a degree of play inherently exists between the threads on the center brace and the threads in the connecting nut block. The heddle frames are in continuous motion and experience continuous vibration. This vibration is transmitted to the center brace, and particularly to the threaded connection between the center brace and the bottom nut block. Thus, due to the inherent play between the threads and the members, a degree of vibration exists between the center brace and the bottom nut block. This continuous vibration results in wear of the threads and the nut block or the center brace requiring frequent replacement of the center brace or the attaching nut block.

The present invention eliminates the vibration between the center brace and the top and bottom rails and provides a significantly improved center brace assembly.

OBJECTS AND SUMMARY OF THE INVENTION

It is a principal object of the present invention to provide an improved center brace assembly for a heddle frame.

An additional object of the present invention is to provide a center brace assembly which eliminates vibration between the center brace and its attaching points on the heddle frame.

Yet another object of the present invention is to provide a more reliable center brace assembly for a heddle frame which requires less maintenance and replacement of wear components.

And still another object of the present invention is to provide a heddle frame incorporating an improved center brace assembly.

Additional objects and advantages of the invention will be set forth in part in the following description, or may be obvious from the description, or may be learned through practice of the invention.

In accordance with the objects of the invention, a heddle frame for supporting a plurality of heddles within the frame is provided. The heddle frame includes a top rail and a bottom rail extending longitudinally relative to the frame. End members connect each end of the top rail and the bottom rails so as to form a generally rectangular frame structure therewith. Heddle bars are supported on the frame structure wherein heddles are supported by the heddle bars within the frame structure. A center brace extends between the top rail and the bottom rail at a position between the end members for maintaining parallelism of the top and bottom rails. The center brace includes an elongated center portion and first and second flanges at opposite longitudinal ends of the center portion. First and second locking blocks are respectively attached to the top rail and the bottom rail and are configured to respectively receive the first flange and the second flange. The locking blocks exert forces on the first and second flanges to create opposing torques thereon, thereby placing the center portion in torsion and locking the first flange and second flange within their respective locking blocks.

In a preferred embodiment, the first and second flanges are rotationally misaligned with respect to one another on the axis of the center portion, which is preferably in the form of a rod. Applying rotational forces to the flanges so that they move into alignment with each other twists the rod so that it remains in torsion as long as the flanges remain aligned.

In this embodiment the flanges define parallelograms in planes normal to the axis of the center rod. The parallelograms have the same dimensions but, when aligned, are oppositely oriented. That is, when the flanges are aligned they appear 180° out of phase with each other. Thus, because the torsion state of the center rod forces the flanges in opposite rotational directions, the sides of each parallelogram face the direction of the rotational force applied to the flange.

The locking blocks are respectively attached to the top rail and the bottom rail in fixed positions. They define parallelogram slots configured to receive their respective flanges. Thus, the locking block side faces oppose the flange side faces.

The locking blocks are fixed on the top and bottom rails such that the parallelogram slots are aligned with respect to each other. Thus, fitting the flanges into their respective slots twists the center bar, placing it in torsion. The center bar then exerts a rotational force on the flanges. The parallelogram side faces are thus urged toward their opposing stationary slot side faces, thereby locking the flanges within the locking blocks.

The locking blocks are secured to the top and bottom rails by screws or bolts threadedly attached either directly into the rails or indirectly thereto through, for example, a nut block. The rotational force exerted on the locking blocks urges them into a locking relationship with these screws or bolts. The force transferred to the screws or bolts locks them, in turn, with the rail or nut block. The locking relationships between the center brace and the locking blocks, between the locking blocks and the screws or bolts, and between the screws or bolts and the rails or nut blocks substantially eliminate vibration between the heddle frame and the center brace.

BRIEF DESCRIPTION OF THE DRAWINGS

FIG. 1 is a front perspective view of a heddle frame according to the invention;

FIG. 2 is a perspective view of a locking block according to the invention having a flange inserted therein.

DETAILED DESCRIPTION OF THE PREFERRED EMBODIMENTS

Figure 3:
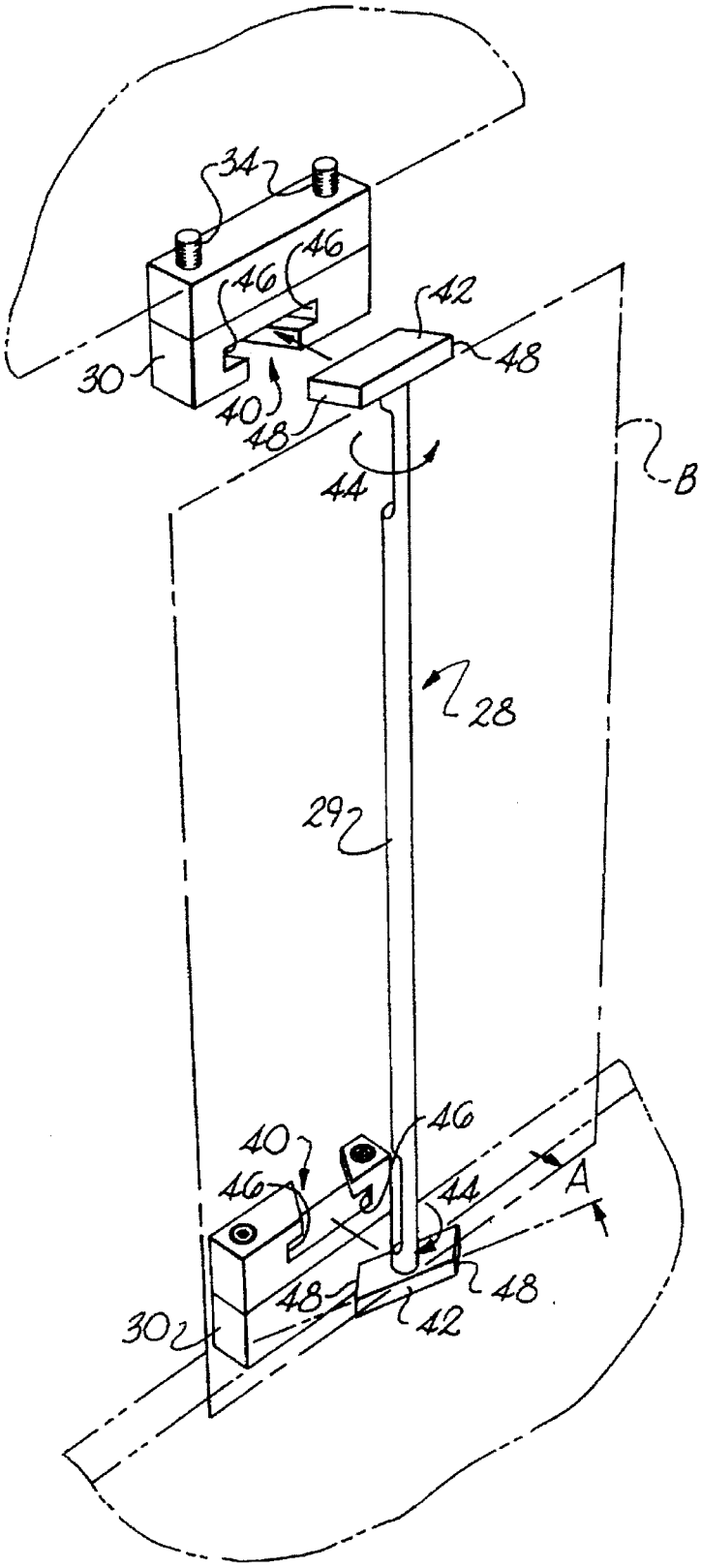
FIG. 3 is a perspective view of the center brace assembly according to the present invention wherein the center brace is shown prior to insertion in the locking blocks.

Reference will now be made in detail to the presently preferred embodiments of the invention, one or more embodiments of which are illustrated in the accompanying drawings. Each example is provided by way of explanation of the invention and is not meant as a limitation of the invention. For example, various modifications and variations can be made in the present invention without departing from the scope or spirit of the invention. It is intended that the present invention cover such modifications and variations. Additionally, the numbering of components is consistent throughout the description and drawings, with the same components having the same number throughout.

A heddle frame 10 is illustrated generally in FIG. 1. Heddle frame 10 comprises a top rail 14 and a bottom rail 16 which extend generally horizontally at a spaced distance from each other. Frame 10 is completed by end members 22 joining top and bottom rails 14 and 16 at each of their ends to form a generally rectangular frame structure. Frame 10 also includes heddle bars 24 on which are suspended a plurality of warp heddles 12, as is commonly understood in the art.

Heddle frame 10 includes a center brace assembly 26. Center brace assembly 26 includes a center brace 28 connected to top rail 14 and bottom rail 16 to provide additional support for maintaining the top and bottom rails parallel to each other. Center brace assembly 26 also includes first and second locking blocks 30 secured to top and bottom rails 14 and 16 and configured to secure center brace 28. Locking blocks 30 may attach directly to top and bottom rails 14 and 16 or may attach thereto indirectly through a nut block.

Referring to FIG. 2, center brace 28 includes an elongated center portion 29. Center portion 29 defines recesses 32 to receive heddle bars 24.

In this embodiment, locking block 30 attaches directly to bottom rail 16 by bolts 34. Locking block 30 is constructed into two sections—a steel bottom section 36 and plastic upper section 38. It should be understood, however, that any and all suitable constructions of locking block 30 are included within the spirit and scope of the present invention.

Locking block 30 also defines a slot 40 to receive flange 42 disposed at the end of center portion 29.

Referring to FIG. 3, flanges 42 define parallelogram shapes in planes normal to the axis of center portion 29. Flanges 42 are rotationally misaligned with respect to each other by an angle A. Angle A is sufficient enough to provide the required torsion for maintaining center brace 28 locked between the top and bottom rails, but not so large as to make manual attachment of center brace 28 impossible. In a preferred embodiment, angle A is approximately 15°. Furthermore, the parallelograms defined by the opposing flanges 42 are oppositely oriented. That is, if aligned, the parallelograms would be 180° out of phase.

Slots 40 define parallelograms to receive their respective flanges 42. Locking blocks 30 and slots 40 are secured in fixed positions on top and bottom rails 14 and 16 and are aligned with one another. Thus, insertion of flanges 42 into slots 40 forces flanges 42 into alignment with plane B, closing angle A.

The forced alignment of flanges 42 twists center portion 29, placing center portion 29 in torsion and creating opposing rotational forces indicated at 44 on flanges 42. The opposing forces create opposing torques on flanges 42.

The parallelogram shapes of flanges 42 and slots 44 are configured so that the sides 46 of slots 40 oppose, at side faces 48 of flanges 42, the rotational movement of flanges 42 urged by rotational force 44. Accordingly, the force at the interfaces between sides 46 and 48 of slots 40 and flanges 42 create a locking condition between flanges 42 and locking blocks 30. Additionally, the rotational forces exerted on locking blocks 30 create a locking condition between locking blocks 30 and their respective bolts 34. The misalignment force thus exerted on bolts 34 creates a locking condition between bolts 34 and respective top and bottom rails 14 and 16.

It should be understood by those of ordinary skill in the art that various suitable embodiments of the present invention are encompassed by the scope and spirit thereof. For example, one of the locking blocks 30 may be rotatably mounted on a top or bottom rail so that it may be rotated to receive a misaligned flange 42. A locking mechanism, for example a rachet, may be used to lock the locking block 30 as it is rotated back into position in alignment with its opposing locking block, thereby placing center portion 29 in torsion. It if further more understood that various configurations of locking blocks 30, slots 40 and flanges 42, including the shapes thereof, are within the scope of the present invention. For example, secondary flanges may be provided on flanges 42 or center portion 29 to facilitate insertion of flanges 42 into locking blocks 30. Furthermore, various configurations of center brace 28 are possible.

It will be apparent to those skilled in the art that various modifications and variations can be made in the present invention without departing from the spirit and scope of the invention. For example, features illustrated or described as part of one embodiment can be included in another embodiment to yield a still further embodiment. It is intended that the present invention cover such variations and modifications as come within the scope of the appended claims and their equivalents.

I claim:

1. A center brace assembly for use with heddle frames to maintain parallelism between the top and bottom rails of the heddle frames, said assembly comprising:

a center brace having a length to extend between, and configured to be connectable between, a top rail and a bottom rail of a heddle frame for maintaining parallelism of said top and bottom rails, said center brace including an elongated center portion, and first and second flanges at opposite longitudinal ends of said center portion; and first and second locking blocks confiqured to be respectively attached to said top rail and said bottom rail and configured to respectively receive and cooperate with said first flange and said second flange and to exert forces on said first and second flanges to create opposing torques thereon, thereby placing said center portion in torsion and locking said first flange and said second flange within their respective locking blocks.

2. The center brace assembly as in claim 1, wherein said first and second flanges are rotationally misaligned with respect to one another on the axis of said center portion.

3. The center brace assembly as in claim 2, wherein said first and second locking blocks are configured to be respectively attached in fixed positions to said top rail and said bottom rail such that said first and second flanges are forced into alignment with respect to one another upon receipt by said locking blocks.

4. The center brace assembly as in claim 1, wherein each of said first and second locking blocks defines a slot configured to receive a corresponding one of said first and second flanges.

5. The center brace assembly as in claim 4, wherein each of said first and second flanges defines at least one substantially straight edge opposing an edge of a corresponding said slot when said flange is received by said corresponding slot such that the force between each corresponding flange and locking block is at least partially applied at the interface of said straight edge and said corresponding slot edge.

6. The center brace assembly as in claim 4, wherein each of said first and second flanges is substantially parallelogram shaped and wherein each of said slots is substantially parallelogram shaped such that each said slot may slidably receive its corresponding flange and such that the force between each corresponding flange and locking block is applied at the interface of lateral edges of the corresponding flange and slot.

7. A heddle frame for supporting a plurality of heddles, said frame comprising:

a top rail and a bottom rail extending longitudinally relative to the frame;

end members connecting each end of said top rail and said bottom rail so as to form a generally rectangular frame structure therewith;

a heddle bar supported on said frame wherein heddles are supported by said heddle bars within said frame structure;

a center brace extending between said top rail and said bottom rail at a position between said end members for maintaining parallelism of said top and bottom rails, said center brace including an elongated center portion, and first and second flanges at opposite longitudinal ends of said center portion; and first and second locking blocks respectively attached to said top rail and said bottom rail and configured to respectively receive and cooperate with said first flange and said second flange and to exert forces on said first and second flanges to create opposing torques thereon, thereby placing said center portion in torsion and locking said first flange and said second flange within their respective locking blocks.

8. The heddle frame as in claim 7, wherein said first and second flanges are rotationally misaligned with respect to one another on the axis of said center portion.

9. The heddle frame as in claim 8, wherein said first and second locking blocks are respectively attached in fixed positions to said top rail and said bottom rail such that said first and second flanges are forced into alignment with respect to one another upon receipt by said locking blocks.

10. The heddle frame as in claim 7, wherein each of said first and second locking blocks defines a slot configured to receive a corresponding one of said first and second flanges.

11. The heddle frame as in claim 10, wherein each of said first and second flanges defines at least one substantially straight edge opposing an edge of a corresponding said slot when said flange is received by said corresponding slot such that the force between each corresponding flange and locking block is at least partially applied at the interface of said straight edge and said corresponding slot edge.

12. The heddle frame as in claim 10, wherein each of said first and second flanges is substantially parallelogram shaped and wherein each of said slots is substantially parallelogram shaped such that each said slot may slidably receive its corresponding flange and such that the force between each corresponding flange and locking block is applied at the interface of lateral edges of the corresponding flange and slot.

13. The heddle frame as in claim 7, wherein said first and second locking blocks are attached to respective said top and bottom rails by bolts such that forces on said first and second locking blocks opposing said forces exerted thereby on said first and second flanges creates a locking condition between said first and second locking blocks and their respective bolts, and between said bolts and their respective rail.

* * * * *